US008104737B2

(12) United States Patent
Yli-Äyhö et al.

(10) Patent No.: US 8,104,737 B2
(45) Date of Patent: Jan. 31, 2012

(54) SIDEWALL CONSTRUCTION OF A CASTING MOLD

(75) Inventors: Jukka Yli-Äyhö, Toijala (FI); Kari Vappula, Toijala (FI)

(73) Assignee: Elematic Group Oy, Toijala (FI)

( * ) Notice: Subject to any disclaimer, the term of this patent is extended or adjusted under 35 U.S.C. 154(b) by 265 days.

(21) Appl. No.: 12/421,909

(22) Filed: Apr. 10, 2009

(65) Prior Publication Data

US 2009/0266968 A1 Oct. 29, 2009

(30) Foreign Application Priority Data

Apr. 29, 2008 (FI) ..... 20085388

(51) Int. Cl.
*E04G 9/06* (2006.01)
*B28B 7/00* (2006.01)

(52) U.S. Cl. ..... 249/139; 249/135; 249/120; 249/169; 249/193; 249/219.1; 425/3; 425/DIG. 33

(58) Field of Classification Search ..... 249/139, 249/160, 163, 168, 187.1, 189, 205, 120, 249/135, 161, 169; 248/206.5; 425/3, DIG. 33; 52/127.1, 127.5, 127.7
See application file for complete search history.

(56) References Cited

U.S. PATENT DOCUMENTS

| | | | | |
|---|---|---|---|---|
| 3,195,207 | A | 7/1965 | Fougea | |
| 3,530,540 | A | 9/1970 | Mueller | |
| 3,730,657 | A | 5/1973 | Malet et al. | |
| 4,768,748 | A * | 9/1988 | Leimkuhler et al. | 249/192 |
| 5,277,396 | A * | 1/1994 | Vappula | 249/65 |
| 6,276,657 | B1 * | 8/2001 | Vappula | 249/163 |
| 6,540,201 | B1 * | 4/2003 | Gagnon et al. | 249/139 |
| 6,742,759 | B2 * | 6/2004 | Vappula | 249/139 |
| 6,860,462 | B2 * | 3/2005 | Vappula | 249/139 |
| 2005/0116131 | A1 * | 6/2005 | Samuel | 248/357 |
| 2005/0133681 | A1 | 6/2005 | Schreyer et al. | |
| 2006/0273235 | A1 * | 12/2006 | Sandqvist et al. | 249/134 |
| 2007/0170346 | A1 * | 7/2007 | Vappula | 249/139 |
| 2008/0023621 | A1 | 1/2008 | Wagner | |
| 2008/0315067 | A1 * | 12/2008 | Vappula | 249/189 |
| 2009/0045316 | A1 * | 2/2009 | Von Limburg et al. | 249/1 |

FOREIGN PATENT DOCUMENTS

| | | | |
|---|---|---|---|
| DE | 19961062 | A1 * | 6/2001 |
| DE | 101 30 855 | A1 | 9/2002 |
| EP | 1 547 741 | A1 | 6/2005 |
| EP | 1 900 489 | A2 | 3/2008 |
| FR | 2 680 815 | A1 | 3/1993 |

(Continued)

OTHER PUBLICATIONS

Translation of JP 2003-291123.*
DE 10002993 A1, Jul. 2000, Derwent, Weidner.*

(Continued)

*Primary Examiner* — Joseph Del Sole
*Assistant Examiner* — Dimple Bodawala
(74) *Attorney, Agent, or Firm* — Buchanan Ingersoll & Rooney PC

(57) ABSTRACT

The invention relates to a sidewall construction to be used in casting of concrete elements, said sidewall construction comprising a support construction and a changeable mold surface plate. The support construction of the sidewall construction according to the invention comprises at least one horizontal profile (1) having at least one magnet (2) located therein, by means of which the fixing of the metallic mold surface plate (3) to the support construction is effected.

14 Claims, 4 Drawing Sheets

FOREIGN PATENT DOCUMENTS

Figure 1A:
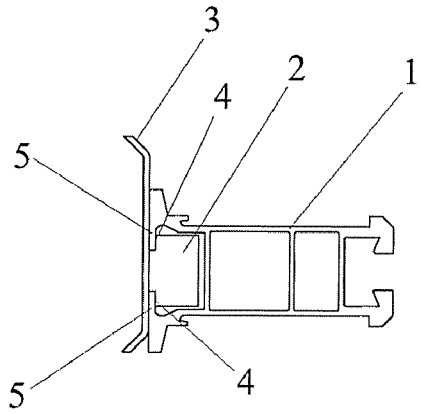

| | | | | |
|---|---|---|---|---|
| GB | 1 319 082 | | | 5/1973 |
| JP | 2000-135709 | A | | 5/2000 |
| JP | 2003048207 | A | * | 2/2003 |
| JP | 2003291123 | A | * | 10/2003 |
| WO | WO 2006094547 | A1 | * | 9/2006 |
| WO | WO 2007/043897 | A2 | | 4/2007 |

OTHER PUBLICATIONS

Finnish Search Report (with English translation of category of cited documents) dated Nov. 12, 2008.

European Search Report dated May 19, 2011 for European Application No. 09 39 7512.

* cited by examiner

SIDEWALL CONSTRUCTION OF A CASTING MOLD

The present invention relates to a sidewall construction of a casting mold to be used in casting concrete elements, said sidewall construction comprising a support construction and a changeable mold surface plate. More precisely, the invention concerns a support construction of a sidewall construction comprising a magnetic fixing to the mold surface plate.

Detachable sidewalls of casting molds for elements cast of concrete are known in the art, said sidewalls being equipped with different fixing solutions. The sidewalls can be positioned to the casting bed in desired places depending on the size and form of the product to be cast.

When casting wall elements of concrete, the flat mold to be used is in general a table or a tipping mold equipped with sidewalls. A casting machine goes above the table and batches the concrete mix to the mold. After the concrete is hardened, the table is tipped about a tilting axle provided on one side of the table, into an almost upright position, the sidewall of the mold ending up to be the uppermost will be removed, and the element is lifted away from the table using lugs provided on its sides. The position of the upper sidewall must be movable depending on the size of the element to be cast, and for that purpose, removable sidewalls can be used. By means of removable and adjustable sidewall parts also openings can be formed to the element in desired places.

The use of magnets for fastening removable sidewalls of the mold to the casting bed is known in the art. Magnets are especially suitable for fixing a sidewall as they attach to the smooth steel surface of the casting bed. To provide a strong attachment of the sidewall, strong magnets must be used effecting bond strength of e.g. 15 kN.

According to Patent publication EP-A-1 900 489 it is known to use a sidewall construction of a casting mold, wherein the sidewall construction of the casting mold is formed of a changeable frame formed of aluminium profiles, where a changeable surface coming against the cast is attached to. In this solution the support construction, i.e. the frame, consists of two horizontal aluminium profiles and of at least one vertical aluminium profile connecting the same. The support construction is fixed to the mold surface plate setting against the product to be cast, being e.g. made of wood, plywood, plastic or steel. The mold surface plate can be fixed to the support construction e.g. with special clamps welded to a steel plate or by machining grooves to the back surface of a plastic mold surface plate for fixing the support construction. It is also possible to set the mold surface plate between an upper and a lower horizontal aluminium profile, whereby the mold surface plate is supported by the back surface thereof to a vertical aluminium profile. In general, sidewalls made of plywood are fixed to an aluminium profile with screws.

The sidewall construction of a casting mold in accordance with the present invention comprises a support construction and a changeable metallic mold surface plate to be fixed thereto by means of a magnet. The mold surface plate in this connection refers to a plate/part to be fixed to the support construction of the sidewall construction by means of a magnet, setting against the product to be cast and defining the outer surface of the product to be cast.

With the solution according to the invention, a sidewall construction is provided being easily and inexpensively convertible for different production runs. In addition, the separate mold surface plate of the sidewall construction according to the invention is easily cleanable and conveniently storable. The invention also enables different and even most difficult shapes and inclinations to be fixed ready to the mold surface plate, and these constructions as ready stock items can be effectively changed, adjusted and continued.

The invention concerns a sidewall construction of a casting mold for casting concrete elements, said sidewall construction comprising a mold surface plate defining the outer surface of the product to be cast and a support construction comprising at least one horizontal profile. The sidewall construction of the present invention is characterized by what is stated in the characterizing part of claim 1.

Figure 1B:
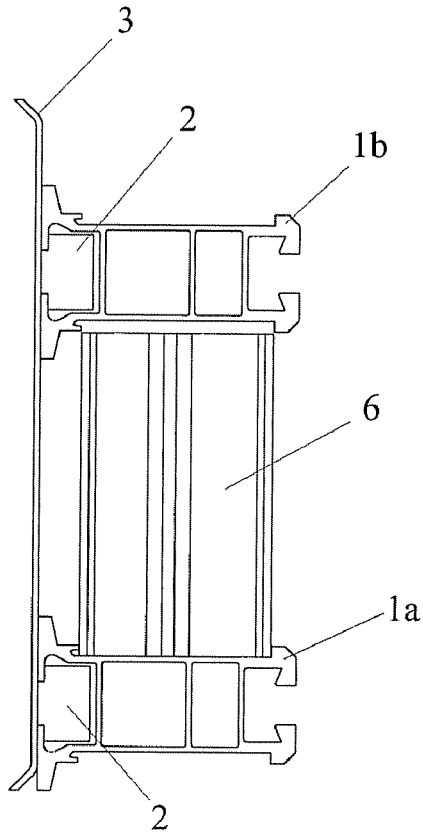
Figure 2A:
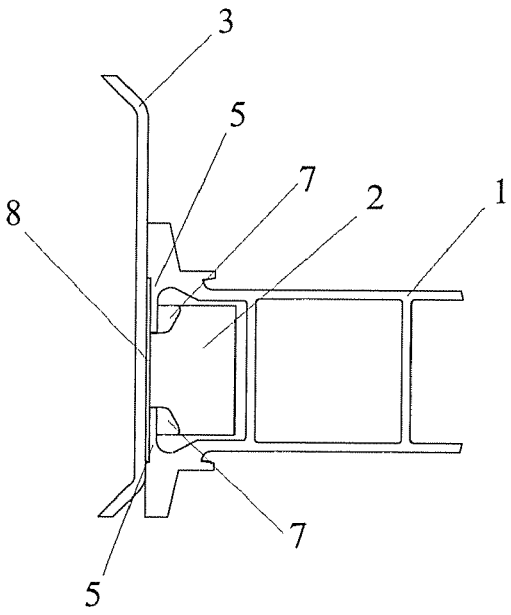
Figure 2B:
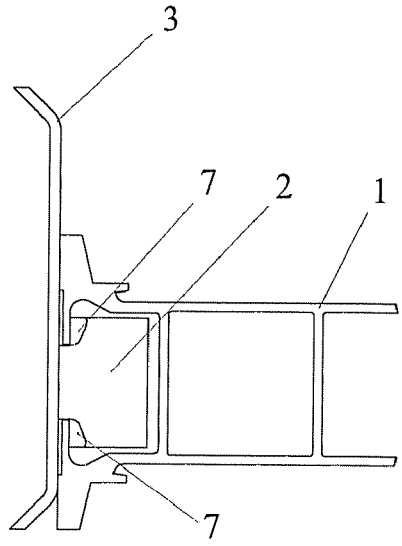
Figure 3:
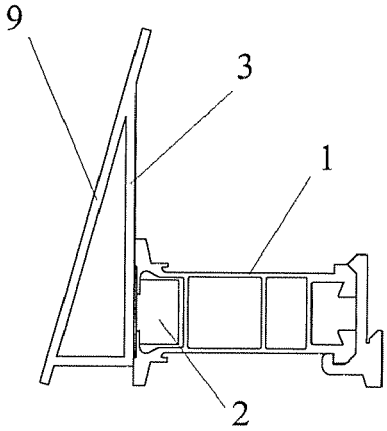
Figure 4:
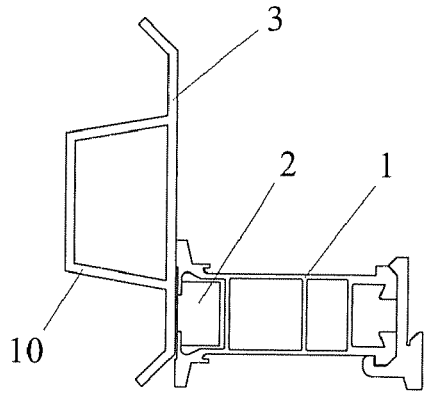
Figure 7:
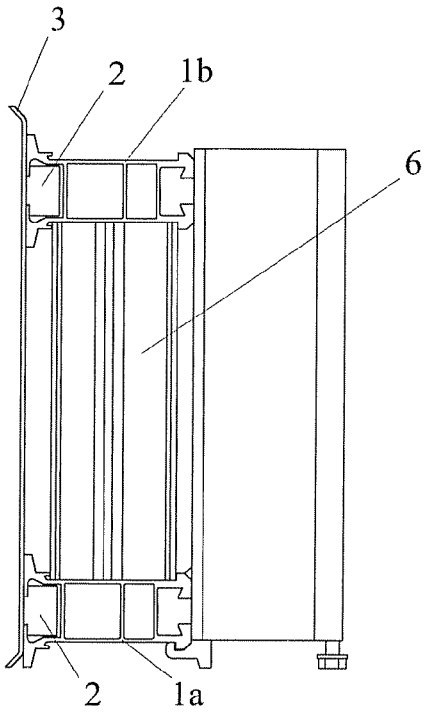
Figure 8:
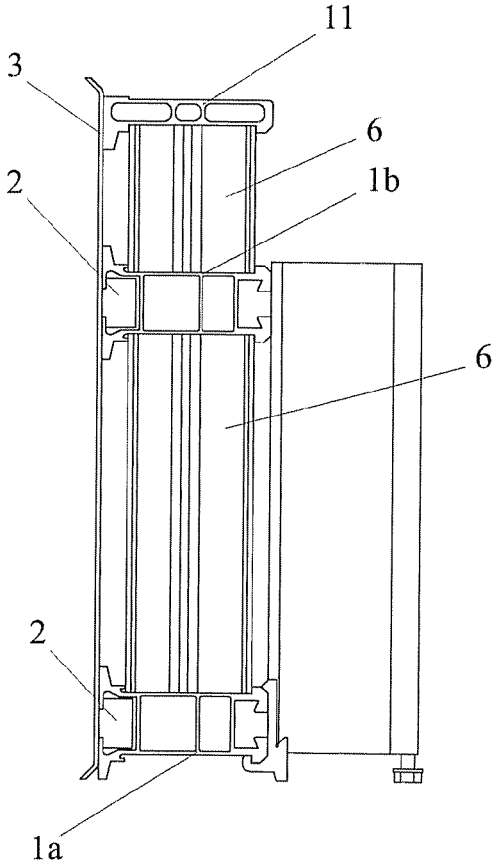
Figure 9:
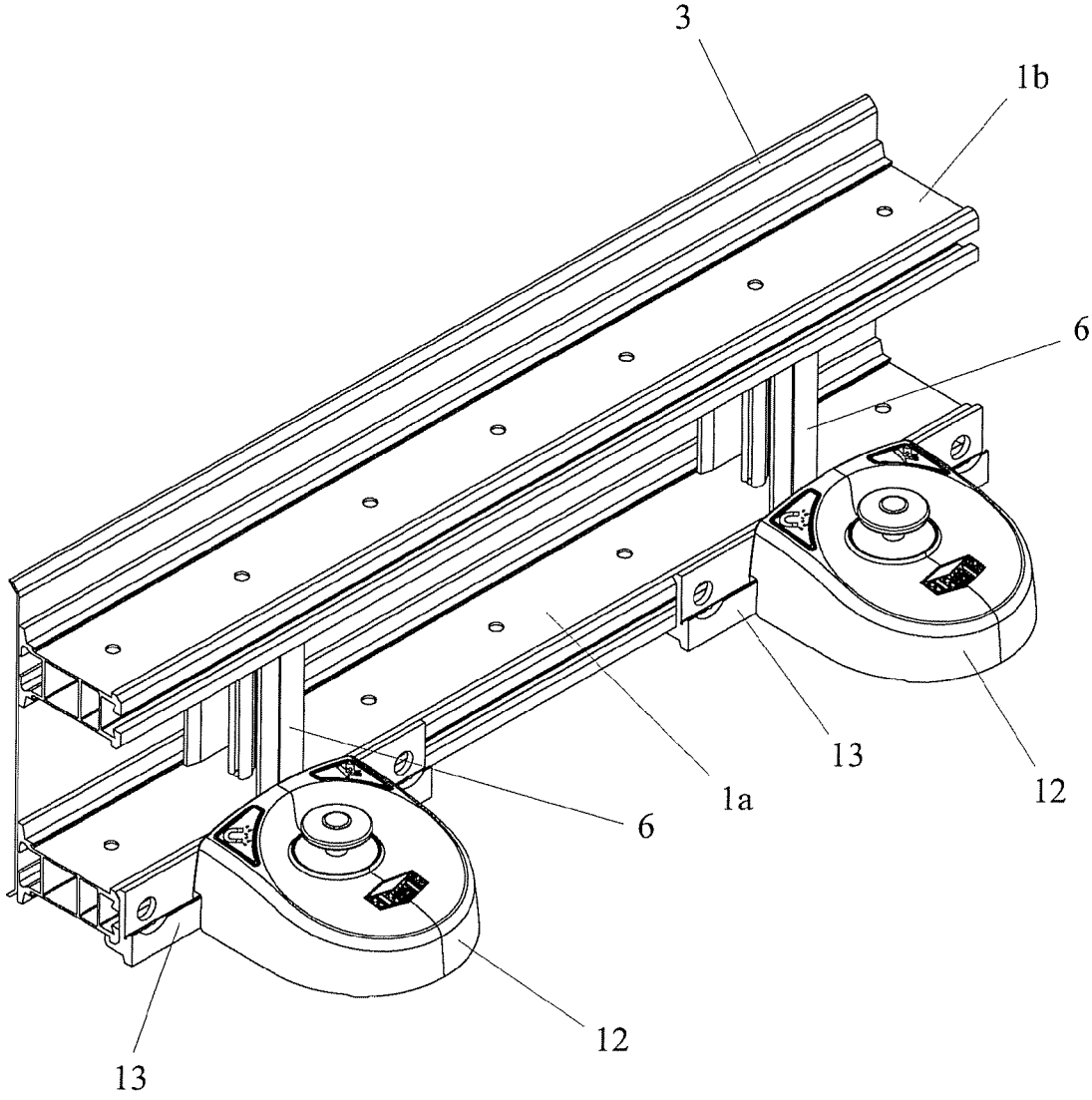

Solutions according to the invention will be described by way of example in more detail in the following, with reference to the enclosed drawings, wherein FIGS. 1A and 1B show cross-sectional schematic views of two sidewall constructions according to the invention, FIGS. 2A and 2B show one preferred embodiment of the sidewall construction according to the invention, FIGS. 3 and 4 show schematic views of examples of alternative mold surface plates to be used in the solution of the invention, FIGS. 5 through 8 show cross-sectional schematic views of embodiments of the sidewall construction of the invention having different support constructions, and FIG. 9 shows one sidewall construction according to the invention fixed to the casting bed by means of a magnetic fixing unit.

FIG. 1A shows a cross sectional view of an example of one sidewall construction of a casting mold according to the invention, comprising a support construction consisting of one horizontal profile 1, at least one magnet 2 being located in said profile for fixing a mold surface plate 3. The construction of the horizontal profile is formed so as to accommodate the magnet 2 or magnets in said profile 1 so that the mold surface plate 3 attaches to the profile 1 by means of the magnet 2. The magnet 2 is kept in the profile 1 by means of shoulders 4 formed to the magnet 2. As shown in FIG. 1A, the shoulders 4 of the magnet come in close contact with the inner surface of an edge 5 of the horizontal profile 1 setting against the mold surface plate 3, when the mold surface plate 3 is fixed to the profile 1 by means of the magnet 2. In other words, as shown in FIG. 1A, the magnet 2 is located in a groove of the horizontal profile 1. The power, size and number of the magnets to be used must be designed so that the mold surface plate 3 is kept firmly fixed to the support construction by means of the magnet 2 during the casting process.

Another embodiment of the support construction of the sidewall construction according to the invention is shown in FIG. 1B. According to this example, the support construction comprises two horizontal profiles 1*a* and 1*b* and at least one vertical profile 6 connecting the same. In this connection the reference numeral 1 refers to a horizontal profile in general. Reference numerals 1*a* and 1*b* are used, when the supporting construction comprises a plurality of horizontal profiles (like in FIG. 1B) so that 1*a* refers to a lower horizontal profile and 1*b* to an upper horizontal profile. All the above mentioned horizontal profiles 1, 1*a* and 1*b* comprise a magnet 2 and have for that part a similar construction. In the case of FIG. 1B, the both horizontal profiles 1*a* and 1*b* comprise at least one magnet 2. The number of vertical profiles 6 depends on the length of the sidewall construction; the longer the sidewall construction is, the more vertical profiles 6 are needed for providing a support construction firm enough. Combining of the sidewall constructions according to the invention can be made quickly and simply, whereby the long edge of the casting mold can comprise a plurality of sequential sidewall constructions. In addition, different provisions like window and door openings can be easily arranged.

Support construction formed of the profiles is preferably made of a form profile, especially advantageously of an aluminium profile. Vertical profiles 6 have preferably a form having an adequate depth in the transversal direction of the sidewall construction for providing a sufficient supporting effect for the eventual upper horizontal profile 1*b*, when the casting mold equipped with said sidewall constructions has been filled with concrete mix. The depth of the vertical profile 6 in the longitudinal direction of the sidewall construction is basically defined by the adequate internal stiffness of the support construction. The depth of the horizontal profiles 1 in the transversal direction of the sidewall construction is defined by the form of the vertical profiles. Fixing of the sidewall construction to the casting bed is effected by means of the horizontal profile 1. If the sidewall construction comprises more than one horizontal profile, the fixing of the sidewall construction is effected by means of the lower horizontal profile 1*a*.

In case the support construction of the sidewall construction is formed of aluminium profiles, they are preferably piece goods, whereby the sidewall construction can easily be manufactured with a desired length and height by cutting the profiles into pieces with a desired length.

The magnets 2 are located to the horizontal profile 1 or profiles 1*a* and 1*b* at suitable distances so, that the attachment of the mold surface plate 3 to the support construction is firm. In case required by the height of the mold surface plate 3 or some other circumstances, magnets 2 can also be located to a plurality of horizontal profiles 1*a* and 1*b* as shown in FIG. 1B. This is usually the case, if the height of the mold surface plate 3 exceeds 300 mm. The size and form of the magnets 2 can also be defined e.g. by the form of the horizontal profile 1 or, on the other hand, the magnet space of the formed profile can have an appropriately designed form. The magnet space in this connection refers to that space or groove in the form profile and especially in the horizontal profile 1, where the magnet 2 or magnets is/are located. Thus, the size of the magnet 2 can vary, but typically it is about 40×40×100 mm. The adhesive force of the magnet 2 can also vary depending e.g. on the mutual distances of the magnets 2 both in horizontal and vertical direction, and on the construction of the mold surface plate and the surface properties thereof.

The adhesive force of the magnet 2 can be e.g. about 2.5 kN. Usually the magnets 2 are located in the horizontal profile 1 at certain distances, e.g. at distances of 200 to 2000 mm, preferably at distances of 800 to 1000 mm, in other words, the magnet 2 is discontinuous, which means that there is a plurality of them in one and the same horizontal profile 1. It is also possible that the magnet 2 is continuous along the whole length of the horizontal profile 1.

According to one embodiment, the attachment of the magnet 2 to the horizontal profile 1 can be steppless, which means that the magnet can be moved lengthwise in the magnet space of the horizontal profile 1, i.e. in the groove, to a desired place according to need. In that case there is preferably a spring part attached to the back surface of the magnet 2 keeping the magnet firmly in place. The back surface of the magnet 2 refers to that surface of the magnet 2 that is located furthest from the mold surface plate 3. The spring part can be e.g. a sprung plastic pad pressing the magnet 2 against the inner surface of the edge 5 of the horizontal profile resting against the mold surface plate. Due to the steppless or sliding attachment, the magnet 2 can be removed from the horizontal profile 1, if necessary. In addition, the adjustment of distances of the magnets in the horizontal direction is easy, which for its part improves the suitability of one and the same support construction for different mold surface plates 3. According to another embodiment, the magnet 2 can be locked immovably in its place by extruding glue material to the lower part of the magnet space at the desired fixing place of the magnet.

The mold surface plate 3 is made of metal, preferably of steel. According to one embodiment, the fixing surface of the mold surface plate 3 can have nodules, providing an especially firm and tight attachment to the support construction. The fixing surface refers to that surface of the mold surface plate 3 that comes against the support construction. The nodules are preferably formed so that they set to those places of the magnet space, i.e. groove, of the horizontal profile 1, that are without magnets 2. A mold surface plate with nodules allows the use of weaker magnets without loosing the firmness of the sidewall construction and thus facilitates the loosening of the mold surface plate 3 from the support construction.

FIGS. 2A and 2B illustrate as a series of pictures one preferred embodiment of the present invention. FIG. 2A shows the initial situation, where the magnet 2 is not yet attached to the mold surface plate 3. In FIG. 2B the mold surface plate is firmly and tightly attached to the magnet 2, and thus also to the support construction. As shown by FIG. 2A according to a preferred embodiment of the invention, the magnet 2 comprises a flexible side construction/flexible shoulders 7 setting against the inner surface of the edge 5 of the horizontal profile 1 resting against the mold surface plate 3. Due to the flexible side construction 7 of the magnet, it is possible to leave a gap 8 between the mold surface plate 3 and the magnet 2. This gap can be provided e.g. by forming the outer surface of the edge 5 of the horizontal profile 1 resting against the mold surface plate 3 so that it is higher at the edges than at the central part thereof. Another alternative (not shown in the Figures) is to keep the outer surface of the edge 5 of the horizontal profile 1 resting against the mold surface plate 3 even, but to dimension the magnet 2 so that in the initial situation there is a gap between the magnet 2 and the mold surface 3. According to FIG. 2B, the flexible side construction 7 is compressed in the fixing phase, and thus the magnet 2 draws strongly the mold surface plate 3 towards the profile 1. This "springlike" flexible fixing guarantees a good and firm attachment of the mold surface plate 3 to the horizontal profile 1 and thus also to the whole support construction. According to the invention, a flexible construction can also be provided to the surface (not shown in the figures) setting against the magnet, in other words to the inner surface of the edge 5 of the horizontal profile 1 resting against the mold surface plate 3 so, that flexible parts are attached to the points of said inner surface facing the shoulders of the magnet 2. In addition to the described alternatives, it is possible according to the invention to attach the flexible parts both to the magnet and to the surface setting against the magnet. The flexible material can be any material suitable for this purpose, like rubber.

The sidewall construction according to the invention enables combining of different inclinations and other forms easily to the mold surface plate. FIG. 3 shows fixing of one mold surface plate 3 having an inclination 9 to the support construction in a sidewall construction according to the invention. The mold surface plate 3 is ready built so that it comprises the inclination 9. Said mold surface plate 3 is fixed to the support construction by means of at least one magnet 2 located in the horizontal profile 1. FIG. 4 shows that it is simple to arrange also difficult forms in the sidewall construction according to the invention, like e.g. indentations 10.

FIGS. from 5 to 8 show by way of example cross-sections of different sidewall constructions of the present invention. The sidewall construction shown in FIG. 5 comprises a horizontal profile 1, a magnet 2 and a mold surface plate 3.

Figure 5:
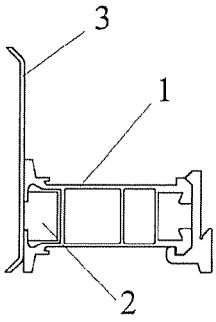

According to FIG. 5, by means of the invention, fixing of mold surface plates 3 having different heights is provided to the support construction, i.e. in the case of FIG. 5 to the horizontal profile 1.

Figure 6:
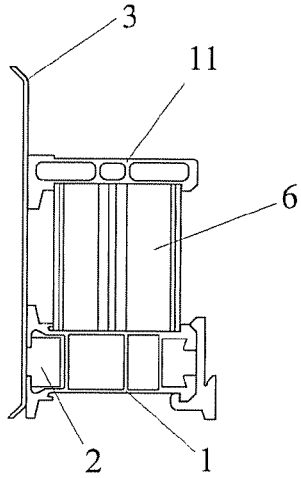

According to FIG. 6, the support construction of the sidewall construction according to the invention can comprise a horizontal profile 1, a horizontal support profile 11 and at least one vertical profile 6 connecting the same, and a mold surface plate 3. In the case of FIG. 6, only the horizontal profile 1 comprises at least one magnet 2. Thus, the construction of the horizontal support profile 11 can be different from the construction of the horizontal profile 1. This kind of an arrangement is applicable, if the mold surface plate 3 has such a height that additional support for the upper part of the mold surface plate 3 is required in order to guarantee the rigidity of the construction, but the at least one magnet 2 of the horizontal profile 1 is enough to guarantee the fixing of the mold surface plate 3 to the support construction.

One sidewall construction according to the invention, shown in FIG. 7, comprises two horizontal profiles, a lower one 1*a* and an upper one 1*b*, at least one vertical profile 6 connecting the same, and a mold surface plate 3. In the case of FIG. 7, the height of the mold surface plate 3 requires providing at least one magnet 2 both to the upper 1*b* and the lower 1*a* horizontal profile. In this way an adequate attachment of the mold surface plate 3 to the support construction is provided.

In the case of FIG. 8, two support constructions according to the invention having different heights are combined, whereby the sidewall construction comprises two horizontal profiles, the lower one 1*a* and the upper one 1*b*, one horizontal support profile 11 and at least one vertical profile 6 connecting these three, and a mold surface plate 3. Both horizontal profiles 1*a* and 1*b* comprise at least one magnet 2, but the support profile 11 is not magnetic or equipped with magnets. Based on the example of FIG. 8 it is obvious, that the sidewall construction according to the invention enables forming of sidewall constructions having different heights also by combining different constructions according the invention.

FIG. 9 shows one way of fixing a sidewall construction of the present invention onto a casting bed by means of a magnet unit 12 known from publication EP-A-1 075 917. The sidewall construction according to FIG. 9 comprises two horizontal profiles 1*a* and 1*b*, two vertical profiles 6 and a mold surface plate 3. At least one magnet (not shown in FIG. 9) is located both in the lower 1*a* and the upper horizontal profile 1*b*. According to FIG. 9, the sidewall construction is fixed to the casting bed by means of two magnet units 12. The magnet units 12 are fixed to the support construction of the sidewall construction by means of connection pieces 13.

The sidewall construction of the present invention for a casting mold provides a sidewall construction having light weight and a simple construction for use in casting of concrete elements, said sidewall construction being easily cleanable and removable from the casting bed. In addition, the sidewall construction according to the invention provides a simple solution for varying the sidewall construction of the casting mold in a required way, when casting small production runs.

Mold surface plates with different heights can be fixed to one and the same support construction of the present invention. In addition, fixing of mold surface plates to the support construction is significantly quicker than fixing the "sides" made of plywood with screws to a profile. The sidewall construction according to the invention also enables easy cleaning and storage of the constructions as ready stock items.

The invention claimed is:

1. A sidewall construction of a casting mold for casting concrete elements, said sidewall construction comprising:

a metallic mold surface plate defining the surface of the product to be cast, and a support construction, said support construction comprising at least one horizontal profile, said horizontal profile comprising a groove having an edge setting against the metallic mold surface plate, at least one discontinuous magnet disposed within the groove of the horizontal profile, said magnet comprising shoulders which come into close contact with an inner surface of said edge of said horizontal profile, wherein the metallic mold surface plate is adapted to be fixed to the support construction by means of said at least one discontinuous magnet, and wherein said support construction is detachably fixed to a casting bed with magnet units separate from said at least one discontinuous magnet.

2. The sidewall construction of a casting mold according to claim 1, wherein the support construction is formed of a form profile.

3. The sidewall construction of a casting mold according to claim 2, wherein the form profile is an aluminium profile.

4. The sidewall construction of a casting mold according to claim 1, wherein the mold surface plate is of steel.

5. The sidewall construction of a casting mold according to claim 1, wherein the fixing surface of the mold surface plate comprises nodules.

6. The sidewall construction of a casting mold according to claim 1, wherein the support construction further comprises a second horizontal profiles and at least one vertical profile connecting said horizontal profile.

7. The sidewall construction of a casting mold according to claim 1, wherein the support construction further comprises at least one horizontal support profile.

8. The sidewall construction of a casting mold according to claim 1, wherein the magnet and/or a surface setting against the magnet comprises a flexible part for securing firm attachment of the mold surface plate to the support construction.

9. The sidewall construction of a casting mold according to claim 1, wherein said fixing of the at least one magnet to the horizontal profile is stepless.

10. The sidewall construction of a casting mold according to claim 2, wherein the mold surface plate is of steel.

11. The sidewall construction of a casting mold according to claim 3, wherein the mold surface plate is of steel.

12. The sidewall construction of a casting mold according to claim 2, wherein the fixing surface of the mold surface plate comprises nodules.

13. The sidewall construction of a casting mold according to claim 1, further comprising a connection piece between said magnet units and said support construction.

14. The sidewall construction of a casting mold according to claim 6, further comprising a connection piece between said magnet units and one of said horizontal profiles of said support construction.

* * * * *